US005122105A

United States Patent [19]

Engel et al.

[11] Patent Number: 5,122,105

[45] Date of Patent: Jun. 16, 1992

[54] SEAT FOR AN EXERCISE APPARATUS

[75] Inventors: Timothy S. Engel, Bloomington; Harold C. Blawd, Burnsville; Michael E. Heutmaker, Long Lake, all of Minn.

[73] Assignee: Nordictrack, Inc., Chaska, Minn.

[21] Appl. No.: 780,395

[22] Filed: Oct. 23, 1991

Related U.S. Application Data

[63] Continuation of Ser. No. 575,967, Aug. 31, 1990, abandoned.

[51] Int. Cl.[5] ..... A63B 21/00

[52] U.S. Cl. ..... 482/72; 482/142; 297/DIG. 9; 297/459; 297/195

[58] Field of Search ..... 272/72, 144, 73; 297/195, 458, 459, DIG. 9; 128/70

[56] References Cited

U.S. PATENT DOCUMENTS

| | | | |
|---|---|---|---|
| 1,139,126 | 5/1915 | Kerns . | |
| 1,750,549 | 11/1927 | Thomson et al. . | |
| 1,866,860 | 6/1932 | Pareira . | |
| 4,047,757 | 9/1977 | Eames et al. . | |
| 4,141,587 | 2/1979 | Holcomb | 297/195 |
| 4,541,627 | 9/1985 | MacLean et al. . | |
| 4,746,112 | 5/1988 | Fayal | 272/72 |
| 4,795,147 | 1/1989 | Seal . | |
| 4,798,378 | 1/1989 | Jones . | |
| 4,840,372 | 6/1989 | Oglesby et al. | 272/72 |
| 4,867,447 | 9/1989 | Johnson . | |
| 4,923,193 | 5/1990 | Pitzen et al. | 272/73 |
| 4,953,193 | 9/1990 | Lo | 272/73 |

OTHER PUBLICATIONS

Exhibit A, X-Oarcizer advertisement, by Martin Marine Company, Inc.

Exhibit B, Anatomy of a Water Rower brochure, by WaterRower Inc.

Exhibit C, The Concept II Rowing Ergometer brochure, by Concept II, Inc. dated 1990.

Exhibit D, The Dynamics of Rowing on an Altero 503 Rower Brochure, by Technologies, Inc.

Exhibit E, Avita Paraflex II The Power Center advertisement, by Avita.

Exhibit F, R701 Air Rower brochures, by Tunturi, Inc. dated 1989.

*Primary Examiner*—Richard J. Apley

*Assistant Examiner*—Lynne A. Reichard

*Attorney, Agent, or Firm*—Merchant, Gould, Smith, Edell, Welter & Schmidt

[57] ABSTRACT

A seat (12) for an exercise apparatus is disclosed. The seat (12) includes a seat member (40), a back member (60), and a pair of wing members (67) that form an integral part of the back member (60). The pair of wing members (67) define a substantially vertical gap (68) therebetween. The back member (60) supports a rower's back when the rower is sitting on the seat member (40). The back member (60), including an pair of wing members (67), is designed to deflect backward during the drive portion of the rowing motion. The pair of wing members (67) are designed to additionally deflect in such a manner that they cup the rower's back during the drive portion of the rowing motion. A supportive insert (80), which extends into the seat member (40) and the back member (60), affects the flexibility of the back member (60) and the pair of wing members (67). The seat (12), including its foam exterior (90), is configured to maximize the comfort of the rower.

19 Claims, 5 Drawing Sheets

FIG.3
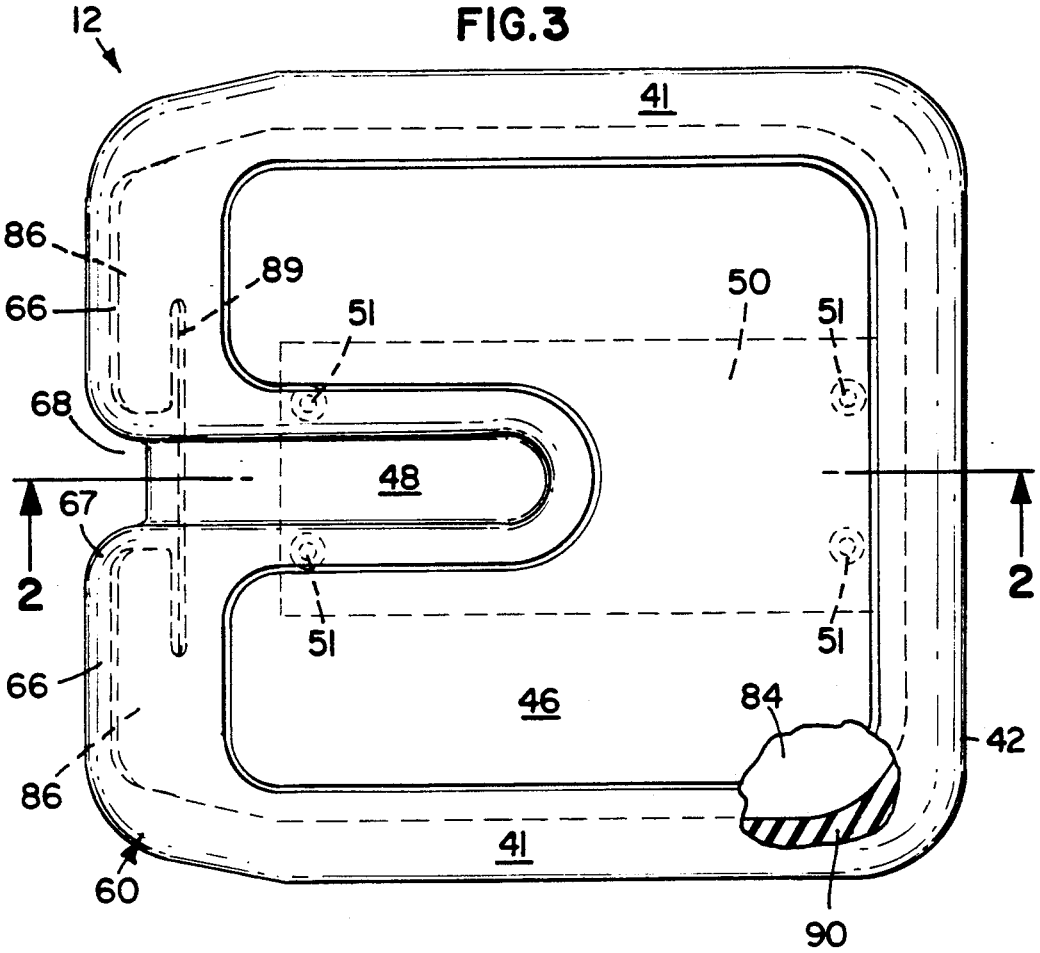
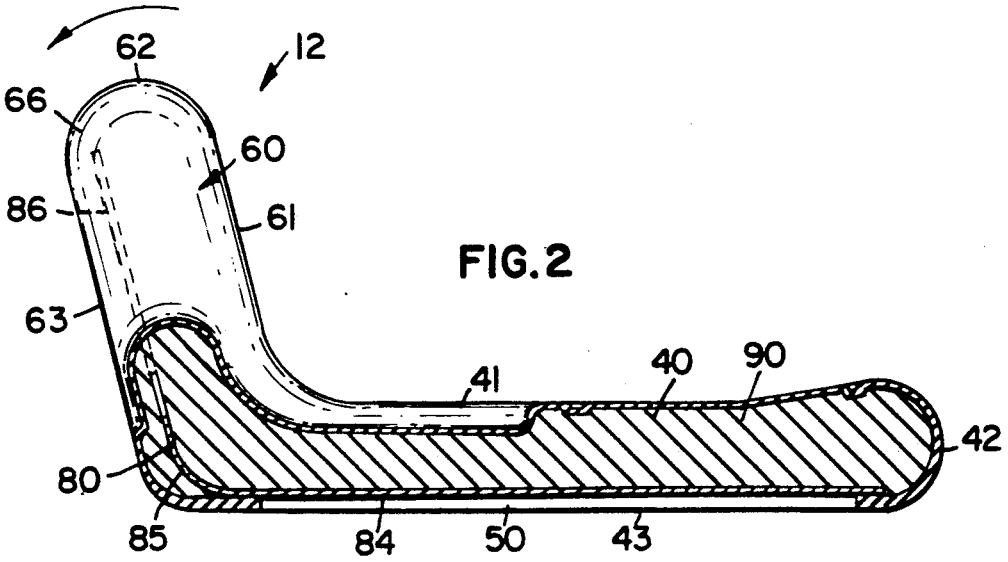
FIG.2

SEAT FOR AN EXERCISE APPARATUS

This is a continuation of U.S. application Ser. No. 07/575,967, filed Aug. 31, 1990, which was abandoned upon the filing hereof.

FIELD OF THE INVENTION

The present invention relates generally to seats and more particularly to a seat for a rowing machine exercise apparatus.

BACKGROUND OF THE INVENTION

A rowing machine exercise apparatus is designed to simulate the motion of a person rowing a boat. In general, such a rowing machine has a handle or a pair of pivoted rowing arms, which the rower pulls toward his body, and a seat, which slides along a track. The rowing motion basically consists of a drive portion, in which the rower pulls the handle or arms and pushes off with his legs to slide backward along the track, and a recovery portion, in which the rower urges the seat forward along the track.

One type of seat for such a rowing machine, which may be referred to as a "biscuit seat," is substantially round and flat and made of wood or plastic. Another type of known seat, which may be referred to as a "saddle seat," is somewhat contoured and made of molded foam. In either case, the seat provides no back support and a minimal surface on which the rower can sit.

The hard flat surface of the biscuit seat is relatively uncomfortable because there is no relief for the bony portions of the rower's buttocks, including the pelvis and femurs. The rigid nature of the bones and their proximity to the seat cause discomfort because a substantial amount of the rower's weight is supported on the relatively small area of bone that is in contact with the hard seat. In view of the discomfort, a person is less likely to exercise with such a rowing machine. Thus, it is desirable to provide a seat that relieves the pressure on the bony portions of the rower's buttocks.

Neither the biscuit seat nor the saddle seat provide support for the rower against movement relative to the seat. In essence, the rower must rely on frictional force between his buttocks and the seat to prevent slipping around or even off the seat during the rowing motion. In order to generate the necessary frictional force, the rower must exert his back and force his buttocks against the seat. The amount of force required and thus, the stress on the rower's back and the discomfort to the rower's buttocks, is substantial because the contact between the rower and the seat is minimal. Thus, it is desirable to provide a seat that supports the rower against movement relative to the seat.

Typically, a rowing machine includes some type of resistance mechanism, which opposes the rower's pulling of the handle or arms. In pulling against the resistance force, the rower places additional stress and pressure on the back and buttocks, as the buttocks serves as the base or fulcrum from which the rower gets his leverage to pull the handle or arms. The resistance force travels through the rower's arms and down through his back and buttocks to the seat, and the resulting stress on the rower's back can cause injury. In the case of a dual resistance rowing machine, as is disclosed in the common assignee's copending U.S. patent application Ser. No. 537,898, filed on June 13, 1990, there is additional stress on the back because resistance is provided to oppose the sliding of the seat, as well as the pulling of the handle or arms. Thus, it is desirable to provide a seat that supports the rower's back during the rowing motion, and particularly the drive portion.

The threat of injury to the rower's back is compounded by the tendency of most people to lean backward during the drive portion of the rowing motion and forward during the recovery portion of the rowing motion. Although competitive rowers incorporate leaning into their rowing motion in order to maximize their performances, such practice has inherent risks and thus, is not advisable for persons using a rowing machine for general exercise purposes. As a person leans forward or backward, it becomes more difficult to transmit force down through the buttocks to the seat, and the additional stress on the rower's back, as well as the additional flexing of the back, greatly increases the risk of injury. Thus, it is desirable to provide a seat that prevents and/or discourages the rower from leaning backward and/or forward while rowing.

The present invention addresses the shortcomings of the common biscuit seat and provides a rowing machine seat with the desired design attributes.

SUMMARY OF THE INVENTION

The present invention provides a seat that includes a seat member, a back member, and a pair of wing members that form an integral part of said back member. The pair of wing members define a substantially vertical gap therebetween. A supportive insert, which extends into the seat member and the back member, affects the flexibility of the back member and the pair of wing members.

In a preferred embodiment, the seat member includes an upper surface that defines a substantially horizontal plane, and the back member includes a front surface that defines a substantially vertical plane. The substantially horizontal plane and the substantially vertical plane define an angle of approximately 104 degrees therebetween. The seat member and the back member are integrally connected with one another. The seat is symmetrical about a reference plane that is perpendicular to both the substantially horizontal plane and the substantially vertical plane.

The supportive insert includes a seat portion that extends into the seat member, a back portion that extends into the back member, and a springy elbow portion that integrally joins the seat portion and the back portion. The back portion includes a pair of wing portions that define an inverted T-shape opening in the back portion. The seat has a foam exterior, including a cushioned area and a hollow.

The present invention includes several features directed toward the comfort of the rower. The foam exterior generally provides a comfortable, cushioned surface on which to sit, thereby relieving some of the pressure on the bony portions of the rower's buttocks, including the pelvis and femurs. Contrary to the common saddle seat, as well as the biscuit seat, the seat of the present invention includes a cushioned area, which provides further relief for the rower's pelvis and femurs, and a vertical gap and a hollow, which provide relief for the bones of the rower's spinal column, including the tailbone.

In the absence of a back member on a rowing machine seat, the substantially horizontal force generated by the rower must be transmitted through the rower's buttocks to a substantially horizontal seat. As a result, the rower must exert his back to force his buttocks against the seat in order to both transmit the force to the seat and maintain his position on the seat. The present invention provides a back member, which is in direct contact with the rower's back, so that the horizontal force generated by the rower can be transmitted from the rower's back directly to the vertical back member. Also, to minimize discomfort to the rower, the force is transmitted to the wing members through the fleshy sides of the rower's back, rather than the bones of the spinal column.

The supportive insert positioned within the seat is designed to allow the entire back member to deflect backward during the drive portion of the rowing motion and rebound forward during the recovery portion of the rowing motion. The back portion of the supportive insert is also designed to allow the individual wing members to twist inward (the back member becomes concave relative to the rower's back) during the drive portion of the rowing motion and rebound forward during the recovery portion of the rowing motion. As a result, during the drive portion of the rowing motion, the backward deflection of the back member (including the wing members) and the inward twisting of the individual wing members tend to absorb shock from the rower's lower back, and during the recovery portion of the rowing motion, the rebounds from the backward deflection and inward twisting tend to propel the rower forward. Additionally, the foam exterior of the seat also tends to absorb shock during the drive portion of the rowing motion.

The back member also allows the rower to firmly position himself in the seat, so that the rower cannot possibly slip back on the seat during the drive portion of the rowing motion. Also, the relatively tacky surface of the foam, as well as its cushion-like quality, reduces the likelihood of the rower slipping relative to the seat. Thus, with the present invention, the rower need not exert his back simply to maintain his position on the seat.

For general exercise purposes, it is desirable for the rower to maintain an upright posture throughout the rowing motion. The contact of the back member against the rower's back prevents excessive backward leaning during the drive portion of the rowing motion and serves as a posture indicator and/or reminder during the recovery portion of the rowing motion. The upright posture of the rower, as well as the support provided by the back member, greatly reduce the stress that would otherwise be placed on the rower's back and thus, greatly reduce the risk of injury.

These and other advantages will be recognized by those skilled in the art upon a more detailed description of the present invention.

BRIEF DESCRIPTION OF THE DRAWING

Referring to the Figures, wherein like numerals represent like parts throughout the several views:

FIG. 2 is a sectional side view of the seat of FIG. 1;

FIG. 3 is a plan view of the seat of FIG. 1;

DETAILED DESCRIPTION OF THE PREFERRED EMBODIMENT

Figure 1:
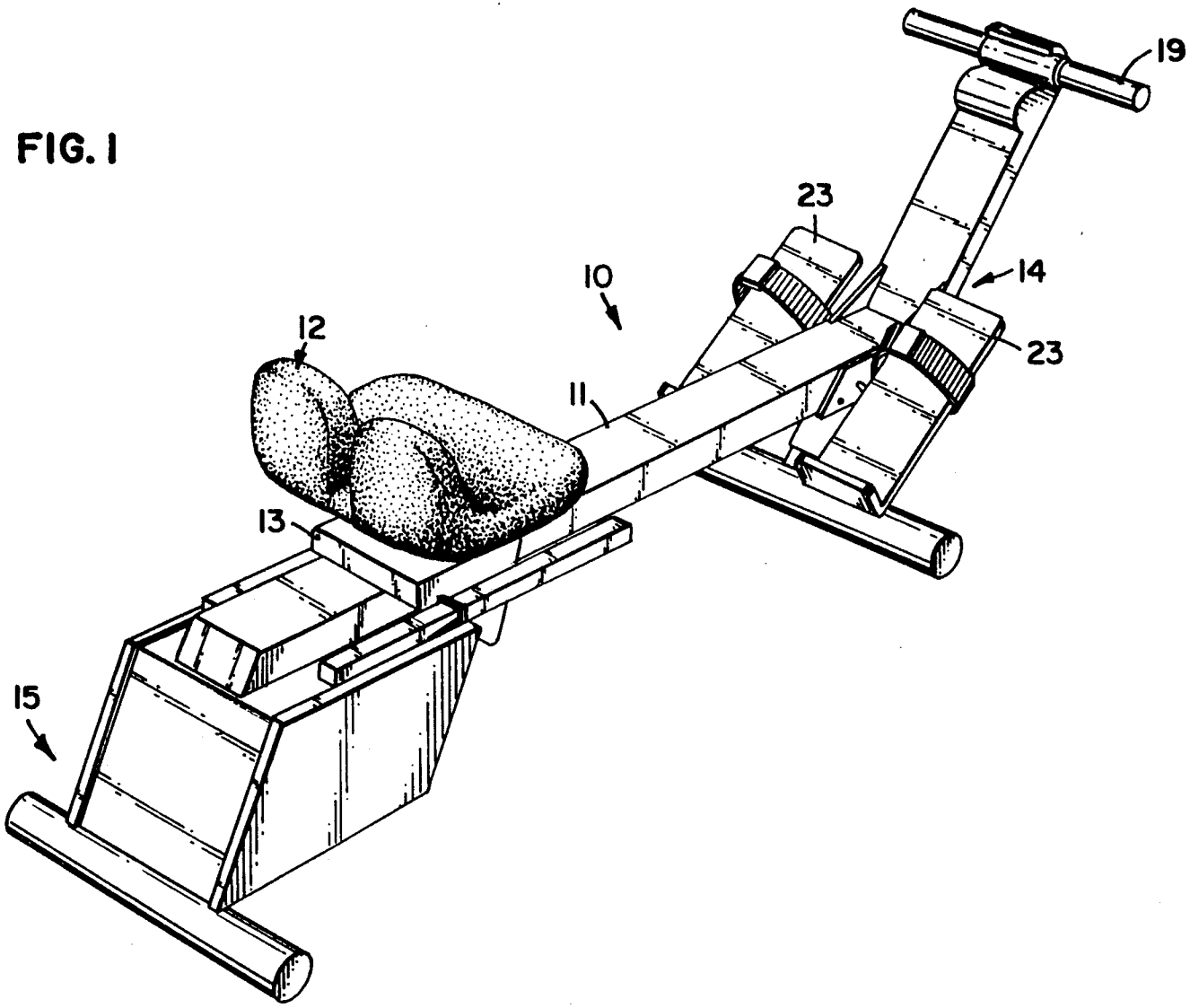
FIG. 1 is a perspective view of the seat of the present invention mounted to a rowing machine exercise apparatus.

Referring to FIG. 1, a preferred embodiment of the present invention 12 is shown together with a dual resistance rowing machine exercise apparatus 10, which is the subject of the common assignee's copending U.S. patent application Ser. No. 537,898, filed on June 13, 1990. The seat 12 is mounted to a carriage 13 by bolts or other means known in the art, and the carriage 13 is slideably mounted to a longitudinal center track 11 by means not shown. Thus, the carriage 13 and the seat 12 slide forward (toward the front 14 of the rowing machine 10) and backward (toward the back 15 of the rowing machine 10) along the track 11.

The rower's feet are anchored at foot plates 23, and the rower pushes with his legs against the foot plates 23 to slide the carriage 13 and the seat 12 backward against a resistance force provided by means not shown. Also, oar handle 19, which is attached to a cord (not shown), is pulled from its resting position against another resistance force provided by means not shown.

Referring to FIG. 2, the seat 12 includes a seat member 40 and a back member 60, which are integrally connected and extend substantially perpendicularly relative to one another. The seat member 40 has an upper surface 41, a front edge 42, and a lower surface 43. The back member 60 has a front surface 61, an upper edge 62, and a back surface 63.

The upper surface 41 of the seat member 40 provides a substantially horizontal surface on which the rower sits, and the front surface 61 of the back member 60 provides a substantially vertical surface which contacts the rower's lower back when the rower sits on the upper surface 41. In the preferred embodiment, the angle between the upper surface 41 and the front surface 61 is approximately 104 degrees, but it is to be understood that a range of angles would be suitable.

The presence of the back member 60 reduces stress on the back in several respects. First, it provides support for the rower against movement relative to the seat member 40. By firmly positioning his lower back against the back member 60, the rower 30 can prevent any backward slippage on the seat 12 during the drive portion of the rowing motion. As a result, contrary to the situation with the typical biscuit seat or saddle seat, the rower 30 need not exert his back in order to maintain his position on the seat.

Second, the back member 60 provides a substantially vertical surface against which the rower 30 can transmit the substantially horizontal force generated by the drive portion of the rowing motion. The "driving" thrust force can be transmitted directly from the rower's back to the back member 60 of the seat 12, rather than through frictional force between the rower's buttocks and the seat. Consequently, the present invention eliminates the stress on the rower's back of transmitting the force down through the buttocks, which was inherent with the common biscuit seat and saddle seat.

Third, the back member 60 discourages the tendency of rowers to lean during the rowing motion. Although competitive rowers incorporate leaning into their rowing motion in order to maximize their performances, such practice has inherent risks and thus, is not advisable for persons using a rowing machine for general exercise purposes. During the drive portion of the rowing motion, the support of the back member 60 prevents the rower from leaning excessively backward, and during the recovery portion of the rowing motion, the contact of the back member 60 serves as a reminder and/or indicator against leaning excessively forward.

A supportive insert 80, made of high carbon steel, is positioned within the seat 12. Those skilled in the art will recognize that the supportive insert 80 may be made from other suitable materials. The supportive insert 80 includes a seat portion 84, which extends into the seat member 40, and a back portion 86, which extends into the back member 60. An elbow portion 85, which integrally joins the seat portion 84 and the back portion 86, is induction heat treated in such a manner that it is "springy". As a result, the back portion 86 can be flexed backward relative to the seat portion 84, as indicated by the arrow in FIG. 3.

The resilient flexibility of the supportive insert 80 allows the back member 60 of the seat 12 to deflect backward and absorb shock from the rower's back during the drive portion of the rowing motion. Additionally, the deflected back member 60 will tend to rebound the rower 30 forward during the recovery portion of the rowing motion. This ability to deflect and rebound makes the seat more comfortable and provides a better "feel" for the rower 30.

The bulk of the seat 12 consists of a self-skinning urethane foam 90 that provides a comfortable cushion with a durable cover. Also, the relative tacky surface of the foam 90, as well as its cushion-like quality, reduces the likelihood of the rower 30 slipping on the seat 12 during the rowing motion.

Referring to FIG. 3, the upper surface 41 of the seat member 40 includes a cushioned area 46 which provides relief for the rower's pelvis and femurs, and a hollow 48, which provides relief for the rower's tailbone Such relief is intended to make rowing more comfortable by reducing the pressure on the bony portions of the rower's buttocks.

A plate member 50, having holes 51, is mounted to the lower surface 43 of the seat member 40. The plate member 50 provides means for bolting, or otherwise mounting, the seat 12 to the carriage 13.

Figure 4:
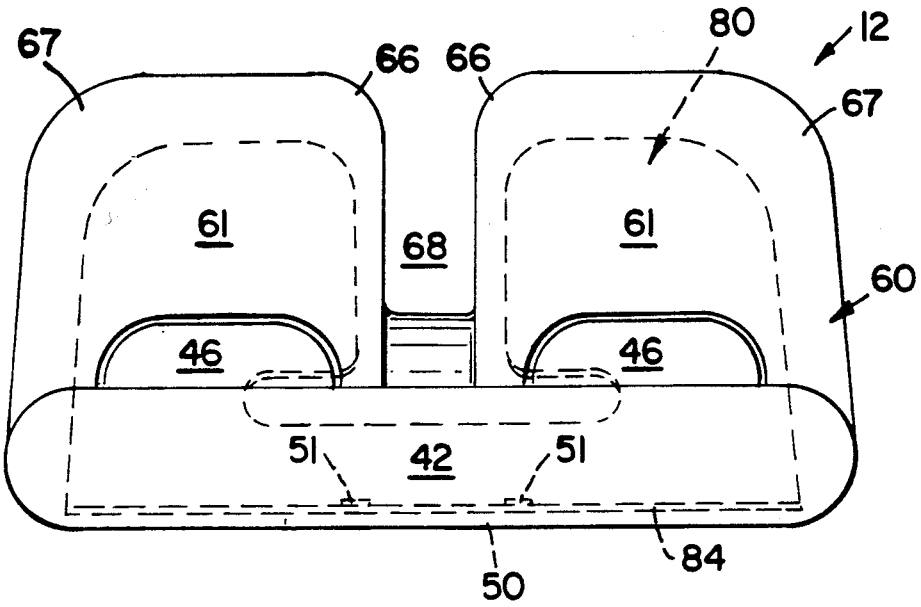
FIG. 4 is a front view of the seat of FIG. 1.

Referring to FIG. 4, the cushioned area 46 and the hollow 48 of the upper surface 41 extend to the front surface 61 of the back member 60. The extended cushioned area 46 and hollow 48 provide relief for the bony portions of the rower's lower back.

The back member 60 includes a pair of adjacent wing members 67, which define a substantially vertical gap 68 therebetween. The gap 68, which is aligned with the hollow 48, provides clearance for the bones of the rower's spinal column, and the wing members 67 contact the sides of the rower's back. The wing members 67 and the vertical gap 68 minimize discomfort, as the force of the rowing motion is transmitted to the back member 60 through the relatively fleshy portion of the rower's back, which is better suited for distributing pressure.

Figure 5:
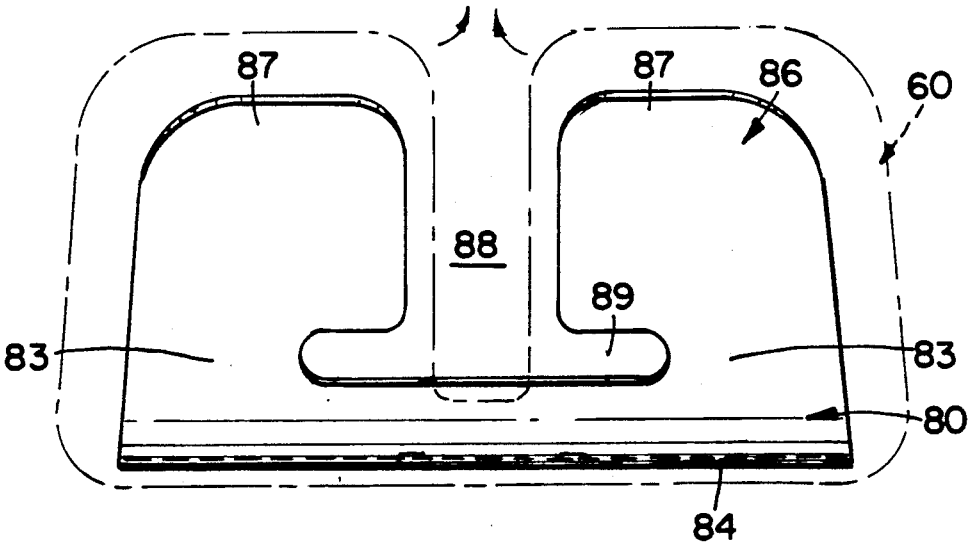
FIG. 5 is a back view of a supportive insert positioned within the seat of FIG. 1.

Referring to FIG. 5, the back portion 86 of the support insert 80 includes a pair of adjacent wing portions 87, which are defined by a substantially vertical slot 88 and a substantially horizontal slot 89, which combine to form an inverted T-shaped opening in the back portion 86. The nature of the supportive insert 80 is such that wing portions 87 are resiliently flexible about neck portions 83. As a result, the wing portions 87 can be twisted relative to the general orientation of the back member 86, as indicated by the arrows in FIG. 5, in such a manner that the back member 86 becomes concave relative to the rower's back.

Figure 7:
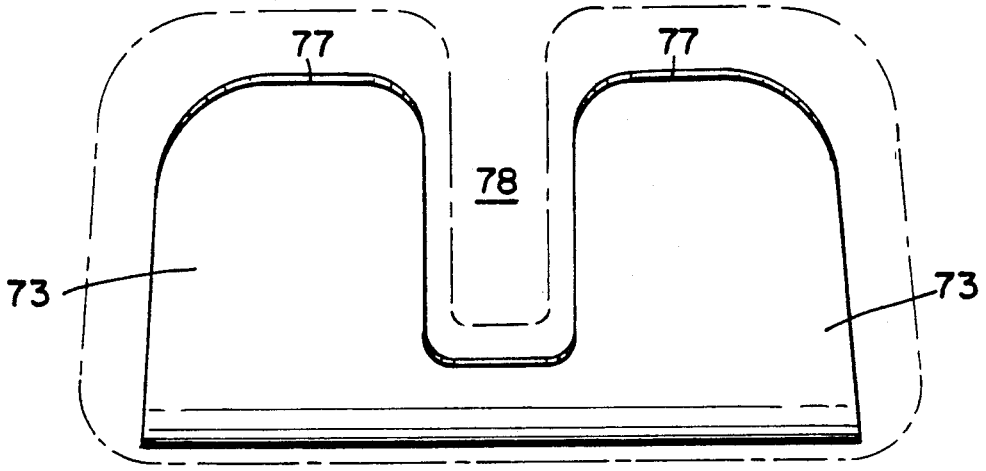
FIG. 7 is an alternative embodiment of the supportive insert of FIG. 5.

Referring to FIG. 7, in an alternative embodiment, there is no substantially horizontal slot, so that the wing portions 77 are defined by the substantially vertical slot 78 therebetween, and the neck portions 73 are the same width as the wing portions 77. The flexibility of the wing portions 77 is a function of the width of the substantially vertical slot and the thickness and particular heat treatment of the steel. The flexibility of the wing portions 87 of the preferred embodiment is also a function of the dimensions of the substantially horizontal slot 89.

The resilient flexibility of the wing portions 87 of the supportive insert 80 allows the wing members 67 of the seat 12 to twist inward and absorb shock from the rower's back during the drive portion of the rowing motion. Essentially, the wing members 67 cradle or cup the rower's back during the drive portion of the rowing motion. Additionally, the twisted wing members 67 will tend to rebound the rower 30 forward during the recovery portion of the rowing motion. This additional ability to twist and rebound further enhances the comfort and "feel" of the seat 12.

Figure 6A:
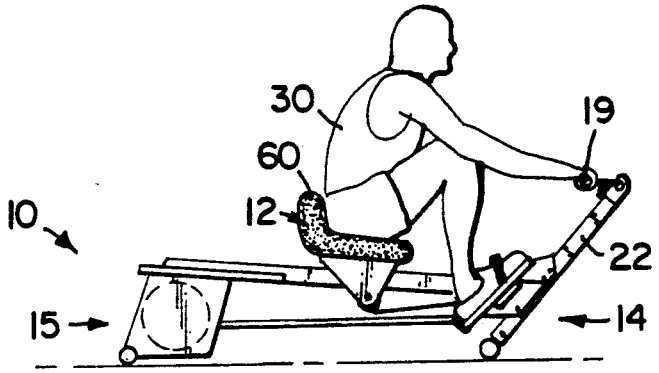
FIGS. 6A-6C are side views of the rowing machine exercise apparatus of FIG. 1 in operation.

Referring to FIG. 6A, in operation of the rowing machine 10, the rower 30 assumes a starting position in which the seat 12 of the present invention is toward the forward end 14 of the rowing machine 10. Rather than lean excessively forward to reach the oar handle 19, the rower 30 should urge the seat 12 forward until he can reach the oar handle 19 without pulling his back away from the back member 60. The concern over excessive leaning becomes more apparent in the context of multiple repetitions of the rowing motion, where there is a tendency to lean forward during the recovery portion of the rowing motion so that the oar handle 19 more readily reaches its rest position, signaling the end of a repetition. In such a case, the rower 30 not only fails to realize the full potential of the exercise, but he also increases the risk of injuring himself by overextending his back. The risk of injury increases as the rower 30 tires and his technique becomes rushed and/or sloppy.

Figure 6B:
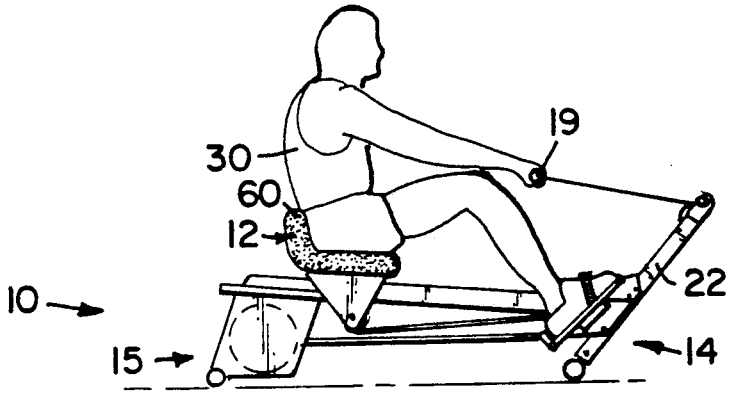
Figure 6C:
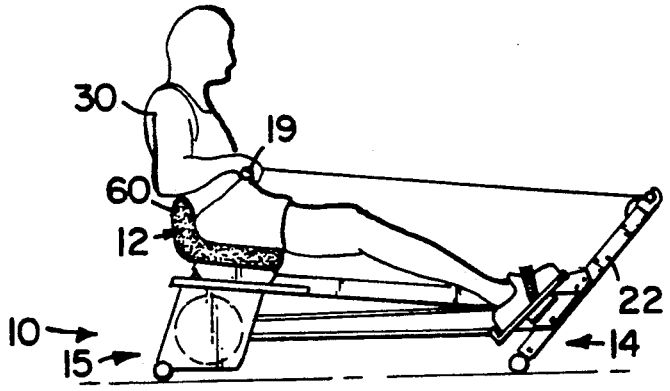

To initiate the drive portion of the rowing motion, the rower pulls the oar handle 19 with his arms and pushes against the foot plates 23 with his legs through the position shown in FIG. 6B to the position shown in FIG. 6C. The back member 60 prevents the rower 30 from leaning excessively backward during the drive portion of the rowing motion. As a result the rowing focuses on the muscles of the legs and arms, rather than requiring unnatural exertion of the back in a relatively prone position.

The "driving" thrust from the leg push is transmitted through the rower's lower back directly to the back member 60 of the seat 12. Thus, the rower 30 need not rely on frictional force between his buttocks and the seat in order to "drive" the seat. In order to minimize discomfort to the rower, the gap 68 provides clearance for the bones of the rower's spine, so that the thrust is transmitted through the fleshy portions of his back. Additionally, the back member 60 deflects backward, the wing members 67 twist inward, and the foam exterior 90 compresses to absorb shock from the thrust.

The rower 30 effectively uses his legs to pin himself against the back member 60, so that he cannot slip back and forth on the seat 12. Also, the surface of the foam exterior 90 is sufficiently tacky to ensure that the rower 30 does not slip across the seat 12. In addition to being less slippery than the common biscuit seat, the seat 12 of the present invention provides the cushioned area 46 and hollow 48 to relieve pressure on the bony portions of the rower's buttocks, including the pelvis and femurs.

As the rower 30 makes the transition from the drive portion to the recovery portion of the rowing motion, the deflected back member 60 and the inwardly twisted wing members 67 rebound and urge the rower 30 forward, reducing the rower's inclination to exert his back in order to return to the forward position. Thus, the seat 12 of the present invention provides several features that relieve stress and minimize discomfort to the rower's back and buttocks, so that a person is more likely to exercise with a rowing machine and to do so for longer periods of time, as well.

While the invention is described with respect to a preferred embodiment, it is to be understood that the invention is not limited to such design nor any specifics of construction. These and other variations of the invention will be apparent to those skilled in the art. For example, although the invention was described win reference to a particular dual resistance rowing machine, the invention is not limited in use to such a rowing machine, but may be used in connection with rowing machines of all types. Furthermore, the invention may be applicable to seats and chairs in general. Accordingly, the present invention is to be limited only by the appended claims.

What is claimed is:

1. A seat of a type that is secured to an exercise apparatus and in which a person can sit, comprising:

1. a seat member;
2. a back member, secured relative to said seat member; and
c. a pair of wing members, forming an integral part of said back member, wherein said pair of wing members defines a substantially vertical elongate gap therebetween, and said pair of wing members is configured to support the back of the person sitting in the seat, and said gap is configured to provide clearance for the vertebrae of the person sitting in the seat.

2. A seat according to claim 1, further comprising a supportive insert, including a seat portion that extends into said seat member, a back portion that extends into said back member, and a springy elbow portion that integrally joins said seat portion and said back portion.

3. A seat according to claim 2, wherein said back portion of said supportive insert includes a pair of wing portions that defines a substantially vertical elongate slot therebetween.

4. A seat of a type that is secured to an exercise apparatus and in which a person can sit, comprising:

a. a seat member;
b. a back member, secured relative to said seat member;
c. a pair of wing members, forming an integral part of said back member, wherein said pair of wing members defines a substantially vertical gap therebetween;
d. a supportive insert, including a seat portion that extends into said seat member, a back portion that extends into said back member, and a springy elbow portion that integrally joins said seat portion and said back portion, wherein said supportive insert includes a pair of neck portions that defines a substantially horizontal slot therebetween; and
e. a pair of wing portions, forming an integral part of said back portion, wherein said wing portions define a substantially vertical slot therebetween, wherein said substantially horizontal slot and said substantially vertical slot combine to form an inverted T-shape opening in said back portion of said supportive insert

5. A seat according to claim 3, wherein said seat member and said back member include a foam exterior.

6. A seat according to claim 5, wherein said seat member includes an upper surface, and said back member includes a front surface, and said upper surface and said front surface define an angle of approximately 104 degrees therebetween.

7. A seat according to claim 6, wherein said seat member and said back member are integrally connected with one another.

8. A seat according to claim 7, wherein said supportive insert is made from high carbon steel.

9. A seat according to claim 1, wherein said seat member includes a weight support surface area, and said second support means has a back support surface area, and said back support surface area is at least one-third as large as said weight support surface area.

10. A seat of a type that is secured to an exercise apparatus and in which a person can sit, comprising:

3. a first support means for supporting a person's weight;
4. a second support means for supporting a person's back and including a pair of wing members that defines a substantially vertical elongate gap therebetween, wherein said pair of wing members is configured to support the back of the person sitting in the seat, and said substantially vertical elongate gap is configured to provide clearance for the vertebrae of the person sitting in the seat; and
5. a supportive insert, operatively connecting said first support means and said second support means, wherein said support insert includes a pair of wing portions that define a substantially vertical slot between, said pair of wing portions forming a part of said second support means.

11. A seat of a type that is secured to an exercise apparatus and in which a person can sit, comprising:

a. a first support means for supporting a person's weight;
b. a second support means for supporting a person's back; and
c. a supportive insert, operatively connecting said first support means and said second support means, wherein said supportive insert includes a pair of wing portions that define a substantially vertical slot therebetween, said pair of wing portions forming a part of said second support means, wherein said pair of wing portions are integrally joined to said supportive insert by a pair of neck portions that define a substantially horizontal slot therebetween, wherein said substantially horizontal slot and said substantially vertical slot combine to form an inverted T-shape opening.

12. A seat according to claim 10, wherein said supportive insert is made of high carbon steel.

13. A seat according to claim 10, wherein said first support means and said second support means have a foam exterior.

14. A seat according to claim 10, wherein said first support means has a weight support surface area, and said second support means has a back support surface area, and said back support surface area is at least one-third as large as said weight support surface area.

15. A seat according to claim 14, wherein said weight support surface area and said back support surface area define an angle of approximately 104 degrees therebetween.

16. A seat according to claim 15, wherein said first support means and said second support means are integrally connected with one another.

17. A seat of a type that is secured to an exercise apparatus and in which a person can sit, comprising:

a. a seat member, including an upper surface that defines a substantially horizontal plane;

b. a back member, integrally connected with said seat member, wherein said back member includes a front surface that defines a substantially vertical plane, wherein the substantially horizontal plane and the substantially vertical plane define an angle of approximately 104 degrees therebetween, and the seat is symmetrical about a reference plane that is perpendicular to both said substantially horizontal plane and said substantially vertical plane;

c. a pair of wing members, forming an integral part of said back member, wherein said pair of wing members define a substantially vertical elongate gap therebetween, and the reference plane passes between said pair of wing members and through said substantially vertical elongate gap;

d. a supportive insert, including a seat portion that extends into said seat member, a back portion that extends into said back member, and a springy elbow portion that integrally joins said seat portion and said back portion;

e. a pair of wing portions, forming an integral portion of said back portion, wherein said wing portions define a substantially vertical elongate opening in said back portion, and the reference plane passes between said pair of wing portions and through said substantially vertical elongate opening; and f. a foam exterior, including a cushioned area and a hollow.

18. A seat of a type that is secured to an exercise apparatus and in which a person can sit, comprising:

a. a seat member, including an upper surface that defines a substantially horizontal plane;

b. a back member, integrally connected with said seat member, wherein said back member includes a front surface that defines a substantially vertical plane, wherein the substantially horizontal plane and the substantially vertical plane define an angle of approximately 104 degrees therebetween, and the seat is symmetrical about a reference plane that is perpendicular to both said substantially horizontal plane and said substantially vertical plane;

c. a pair of wing members, forming an integral part of said back member, wherein said pair of wing members define a substantially vertical gap therebewteen, and the reference plane passes between said pair of wing members and through said substantially vertical gap;

d. a supportive insert, including a seat portion that extends into said seat member, a back portion that extends into said back member, and a springy elbow portion that integrally joins said seat portion and said back portion;

e. a pair of wing portions, forming an integral portion of said back portion, wherein said wing portions define a substantially vertical opening in said back portion, and the reference plane passes between said pair of wing portions and through said substantially vertical opening;

f. a foam exterior, including an cushioned area and a hollow; and g. a pair of neck portions, integrally joining said wing portions to said back portions, wherein said neck portions define a substantially horizontal opening in said back portion, and the reference plane passes between said pair of neck portions and through said substantially horizontal opening.

19. A seat according to claim 18, wherein said front surface is at least one-third as large as said upper surface.

* * * * *